US006412113B1

(12) United States Patent
Guenther et al.

(10) Patent No.: US 6,412,113 B1
(45) Date of Patent: Jul. 2, 2002

(54) BALL GLOVE WITH TEXTILE REINFORCED COMPRESSION MOLDED RUBBER SHELL

(75) Inventors: Douglas G. Guenther, Wheaton; James A. Hansen, Bloomingdale, both of IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 09/945,458

(22) Filed: Aug. 30, 2001

(51) Int. Cl.[7] ..... A41D 13/08
(52) U.S. Cl. ..... 2/19
(58) Field of Search ..... 2/16, 19, 20, 158, 2/159, 161.1, 161.3, 161.6, 167, 168, 243.1; 66/200, 202; 264/257, 259, 546; 428/295.1, 295.4, 297.4; 442/37, 293, 399, 402; 473/205, 300, 451, 458, 464

(56) References Cited

U.S. PATENT DOCUMENTS

| | | | | | |
|---|---|---|---|---|---|
| 187,848 | A | | 2/1877 | Hale | |
| 4,279,681 | A | | 7/1981 | Klimezky | 156/245 |
| 4,359,783 | A | * | 11/1982 | Andrews | 2/161.1 |
| 4,526,828 | A | * | 7/1985 | Fogt et al. | 2/16 |
| 4,817,209 | A | | 4/1989 | Lehmann et al. | 2/19 |
| 4,896,376 | A | | 1/1990 | Miner | 2/19 |
| 5,359,735 | A | * | 11/1994 | Stockwell | 2/243.1 |
| 5,402,537 | A | | 4/1995 | Kolada | 2/19 |
| 5,572,739 | A | | 11/1996 | Kolada et al. | 2/19 |
| 5,592,688 | A | | 1/1997 | LaRonge et al. | 2/19 |
| 5,706,519 | A | | 1/1998 | Cooper | 2/19 |
| 5,759,123 | A | | 6/1998 | Ou | 473/599 |
| 5,772,545 | A | | 6/1998 | Ou | 473/605 |
| 6,210,620 | B1 | * | 4/2001 | Wilke | 264/257 |
| 6,210,798 | B1 | * | 4/2001 | Sandor et al. | 428/297.4 |

* cited by examiner

*Primary Examiner*—Danny Worrell
*Assistant Examiner*—Gary L. Welch

(57) ABSTRACT

A ball glove includes an outer shell which is formed from textile or fabric reinforced compression molded rubber. The rubber extends into mesh openings in the textile and is mechanically integrated with the textile. The textile strengthens the rubber and reduces the possibility that the rubber will tear at holes for stitches or laces.

8 Claims, 4 Drawing Sheets

BALL GLOVE WITH TEXTILE REINFORCED COMPRESSION MOLDED RUBBER SHELL

BACKGROUND

This invention relates to ball gloves, and, more particularly, to a ball glove which includes a shell formed from textile reinforced compression molded rubber.

Ball gloves such as baseball gloves and softball gloves conventionally include an outer shell and an inner liner. The outer shells of ball gloves have historically been made of leather. However, leather is expensive.

In order to reduce cost, the outer shells of some ball gloves are made from less expensive synthetic materials, for example, vinyl. Vinyl gloves are particularly suitable for low price point gloves which are sold at a price which is substantially less than the price of a leather glove.

However, less expensive gloves such as vinyl gloves are inferior in quality to leather gloves. Synthetic materials are usually not as strong as leather, and such materials are subject to tearing at holes which are made in the material for lacing and stitching. Also, synthetic materials often cannot be easily shaped to form a ball pocket or broken in to provide a hinging action that facilitates closing the glove around a ball.

SUMMARY OF THE INVENTION

The invention provides a ball glove with an inexpensive yet strong outer shell which is formed from textile reinforced compression molded rubber. During molding, the rubber flows into the mesh openings of the textile or fabric and mechanically interlocks with the fabric. The fabric reinforces the rubber, strengthens the rubber around openings for laces and stitches, and reduces the possibility that the shell material will tear. The rubber can also be molded so that the shell has a desired shape or function. For example, the shell can be molded with a concave ball,pocket or a hinge line for facilitating closing the glove.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
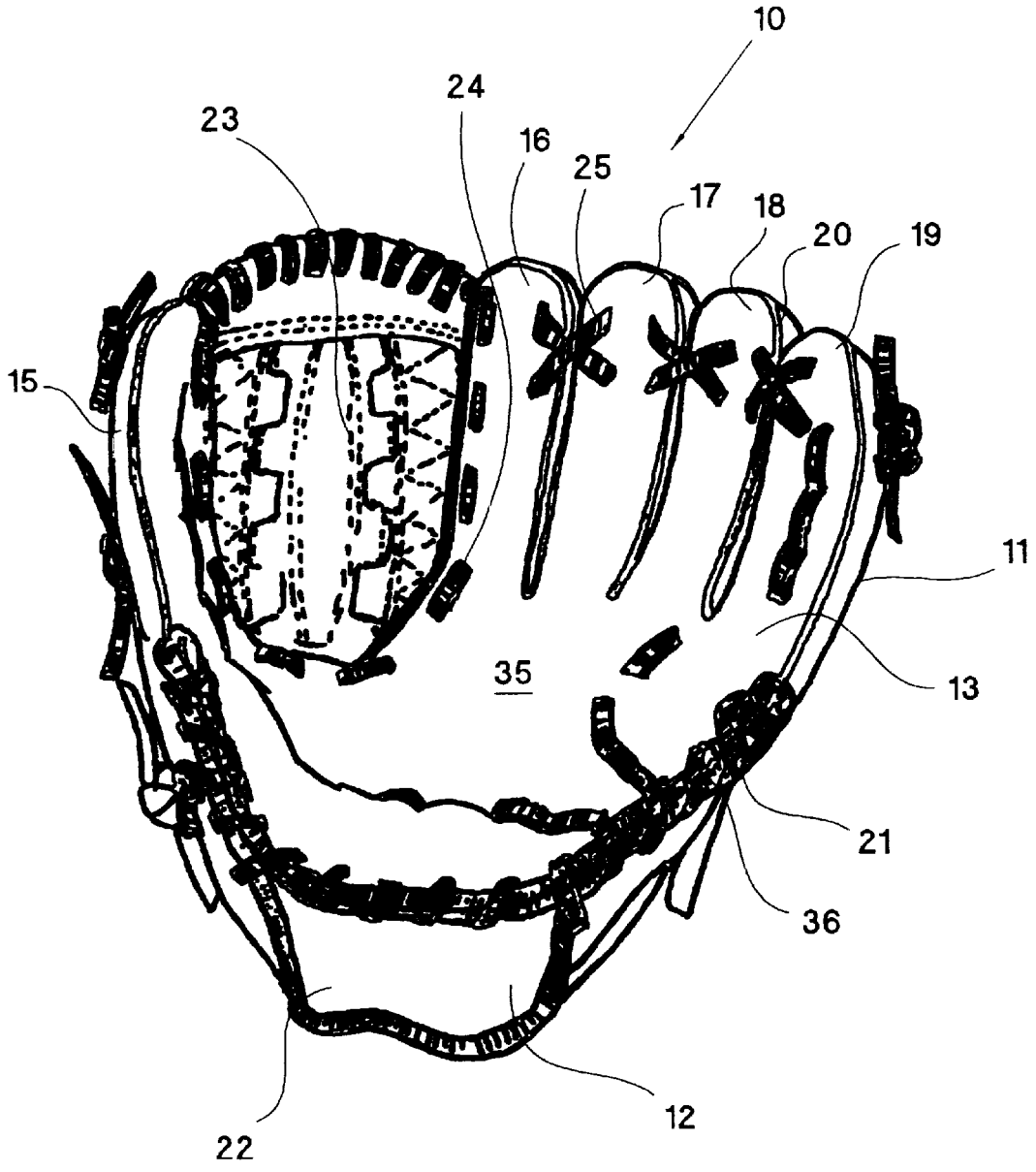
FIG. 1 is a front perspective view of a baseball glove which is formed in accordance with the invention.
Figure 2:
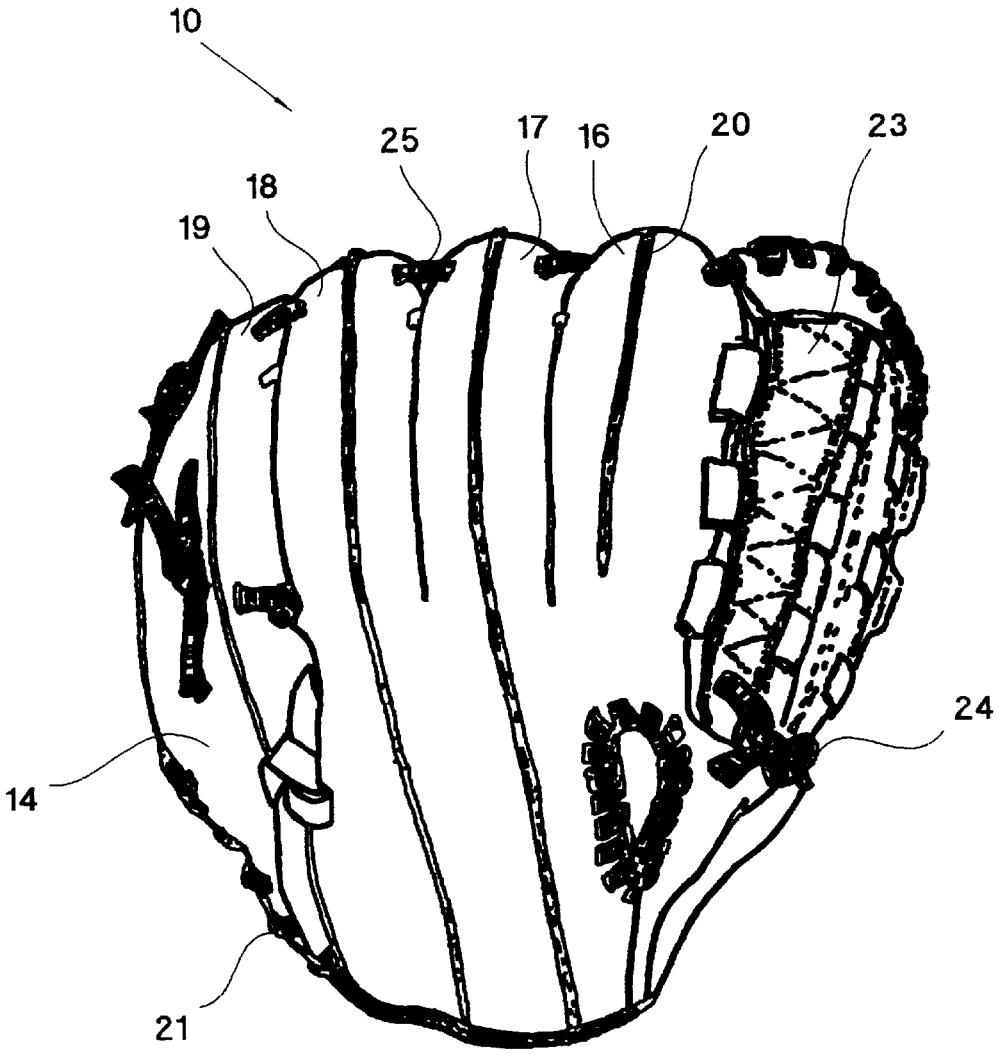
FIG. 2 is a rear perspective view of the baseball glove of FIG. 1.

FIGS. 1 and 2 illustrate a baseball glove 10 which includes an outer shell 11 and an inner lining 12. The outer shell includes a front or palm ply 13 and a back ply 14. The front and back plies 13 and 14 form a thumb stall 15 and four finger stalls 16, 17, 18, and 19. The front and back plies 13 and 14 are stitched together along a plurality of seams 20 which extend up and around the thumb stall 15 and the finger stalls 16–19 and are laced together below the thumb stall 15 and the finger stalls 16–19 by a first lacing 21. The front and back plies 13 and 14 are left unsecured along the bottom of the glove to provide a hand opening 22.

A webbing 23 extends between the thumb stall 15 and the four finger stalls 16 and is secured to the thumb stall 15 and the finger stall 16 by a second lacing 24. A third lacing 25 connects the tips of the finger stalls 16–19.

The inner lining 12 may be conventional and is usually formed from leather. The inner lining 12 includes a palm lining ply and a back lining ply which are secured together to form lining stalls which extend into the stalls 15–19 of the shell 11. The inner lining 12 is stitched to the palm and back plies 13 and 14 of the shell.

Figure 3:
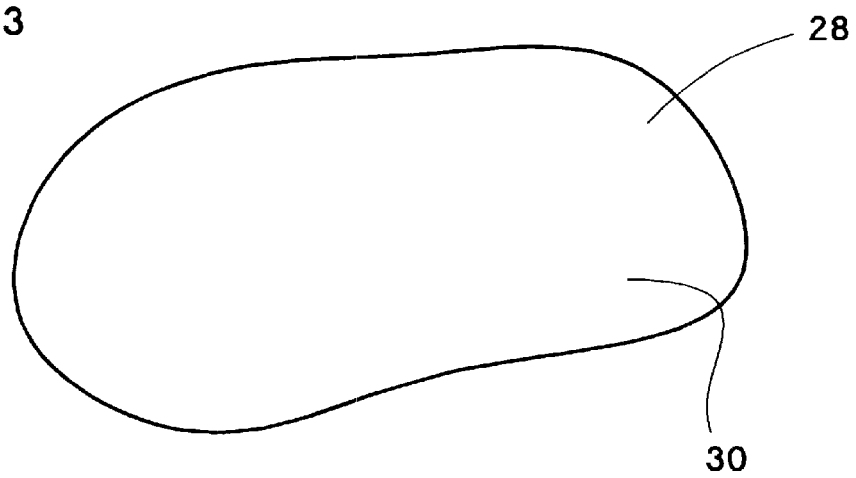
FIG. 3 is a fragmentary plan view of the outer surface of a sheet or panel of textile reinforced compression molded rubber.
Figure 4:
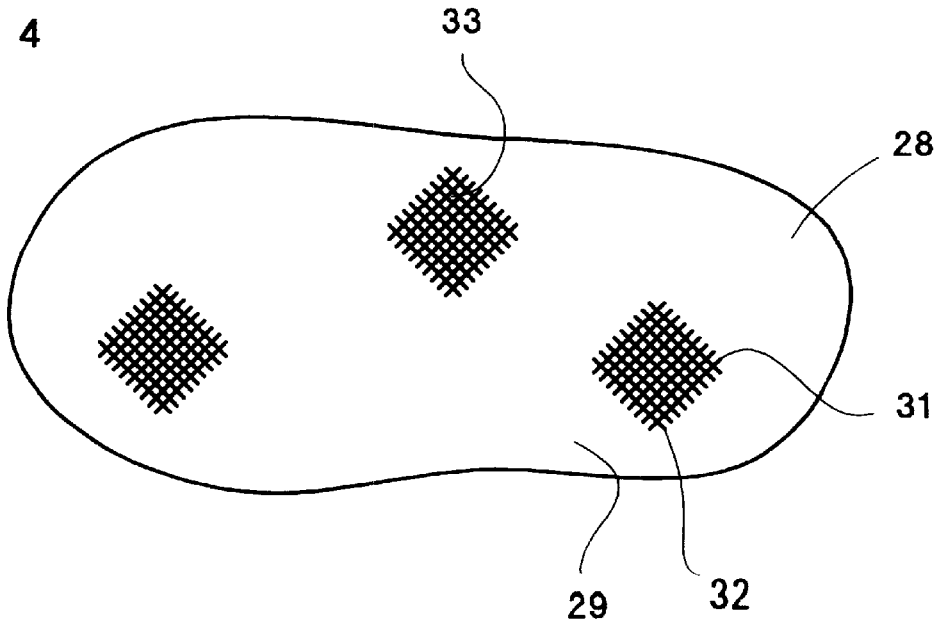
FIG. 4 is a fragmentary plan view of the outer surface of the sheet of FIG. 3.
Figure 5:
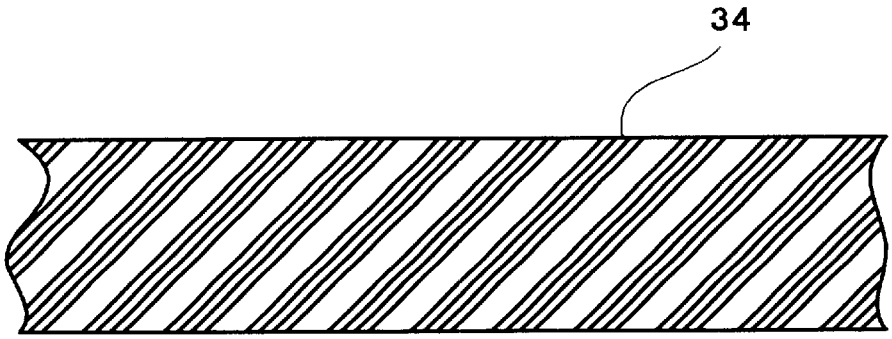
FIG. 5 is a fragmentary sectional view of a rubber sheet which is used to make the sheet of FIG. 4.
Figure 6:
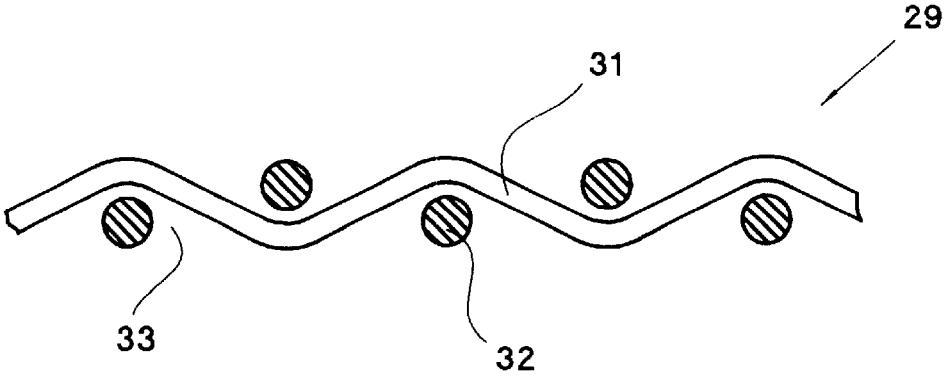
FIG. 6 is a fragmentary sectional view of a fabric sheet which is used to make the sheet of FIG. 4.

Referring to FIGS. 3–5, the palm and back plies 13 and 14 of the shell 11 are formed from a sheet 28 of textile reinforced compression molded rubber. The sheet 28 includes a fabric layer 29 and a rubber layer 30. The fabric layer 29 can be a textile woven fabric, a needle punched fabric or a cloth. The rubber layer 30 can also be formed of a rubber-like material, natural rubber or synthetic rubber.

The fabric layer 29 is advantageously woven from warp and weft threads 31 and 32 which provide mesh openings or interstices 33 between the threads 31 and 32. However, other forms of fabric, such as, for example, needle punched fabric, can also be used so long as the fabric is provided with openings which permit the rubber to interlock with the fabric. Suitable materials for the fabric include polyester, cotton, and nylon.

Figure 7:
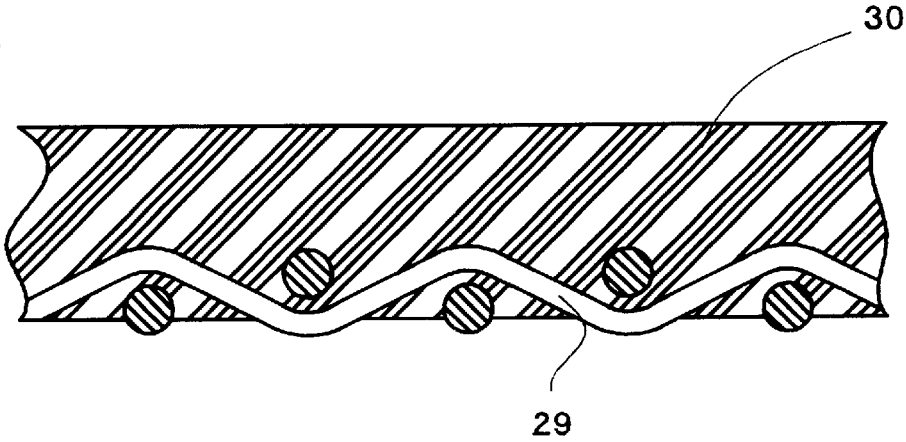
FIG. 7 is an enlarged fragmentary sectional view taken along the line 7—7 of FIG. 3.

The sheet 28 is formed by placing the fabric layer 29 in a cavity of a conventional two part compression mold. A rubber sheet 34 (FIG. 5) is also placed in the mold cavity, the mold is closed, and the rubber is molded under heat and pressure. The rubber softens and/or becomes fluid in the mold and flows into the openings 33 of the fabric and around the threads 31 and 32 of the fabric layer 29 as illustrated in FIG. 7. The rubber thereby forms a mechanical interlock or bond with the fabric layer 29. When the rubber cools, the fabric layer 29 is integrated with the rubber.

The rubber layer 30 of the sheet 28 forms the outer surface of the shell 11, and the fabric layer 29 forms the inside surface of the shell 11. The fabric layer 29 strengthens and reinforces the rubber layer 30, particularly around the holes which are formed for the first, second and third lacings 21, 24, and 25 and the holes which are formed by the stitching along the seams 20. The fabric layer 29 substantially decreases the possibility that a lacing or stitch will tear through the shell material.

The sheet 28 can also be molded into a particular shape. For example, the shell 11 advantageously is shaped to provide a concave ball pocket 35 in the palm portion of the shell. The sheet 28 can be molded by a mold which forms the pocket in the sheet. The shell 11 is thereby provided with a preformed pocket which does not have to be formed by "breaking in" the shell.

The sheet 28 can also be molded with the shapes of the finger stalls 16–19, the thumb stall 15, or other desirable shapes. If desired, one of the molds for molding the textile reinforced rubber can have the shape of the entire front ply 13, and another mold can have the shape of the entire back ply 14. The rubber material is molded in the shapes of the front and back plies, and the shell 11 is thereby preformed into the desired shape.

Ball gloves are desirably flexible enough so that the player can close the thumb stall 15 and the finger stalls 16–19 around a ball in the pocket 35 (FIG. 1) in order to retain the ball in the pocket 35. Some ball gloves are provided with a hinge area 36 below the finger stall 19. The hinge area 36 of leather gloves can be formed by creasing or thinning the leather in the hinge area. A hinge area can be molded into the textile reinforced molded rubber material by shaping the mold cavity to provide a creased area and/or an area of thinner material.

The glove with the textile reinforced rubber shell is a cost effective alternative to a glove with a vinyl shell. The rubber shell also has advantages of increased strength and superior shape and eliminates disadvantages of environmental and health problems.

While in the foregoing specification a detailed description of a specific embodiment of the invention was set forth for the purpose of illustration, it will be understood that many of the details hereingiven may be varied considerably by those skilled in the art without departing from the spirit and scope of the invention.

We claim:

1. A ball glove comprising:

an outer shell, the outer shell having front and back plies and a plurality of finger stalls, the outer shell being formed from fabric reinforced compression molded rubber which includes a layer of fabric having mesh openings and a layer of rubber which extends into the mesh openings of the fabric and is mechanically bonded to the fabric;

an inner lining attached to the outer shell; and a webbing coupled to and extending between two of the finger stalls.

2. The ball glove of claim 1 in which the fabric is a woven material.

3. The ball glove of claim 2 in which the fabric includes warp and weft threads which provide the mesh openings.

4. The ball glove of claim 1 in which the fabric is a needle punched fabric.

5. The ball glove of claim 1 in which the fabric reinforced compression molded rubber of the front ply of the shell has a molded concave pocket.

6. The ball glove of claim 1, wherein the front ply of the outer shell includes a hinge area below at least one of the finger stalls for facilitating closing of the glove.

7. The ball glove of claim 6 wherein the hinge area includes a crease.

8. The ball glove of claim 6 wherein the hinge area has a first thickness, wherein the remaining areas of the front ply have a second thickness, and wherein the first thickness is less than the second thickness.

* * * * *